United States Patent [19]

Delattre

[11] 4,267,680

[45] May 19, 1981

[54] TILE FOR THE CONSTRUCTION OF WALLS OR DIVERSE DISASSEMBLABLE SURFACES

[76] Inventor: Jean Delattre, 245a, Chemin du Roucas Blanc, Marseille, France, 13007

[21] Appl. No.: 22,943

[22] Filed: Mar. 22, 1979

[30] Foreign Application Priority Data

Mar. 24, 1978 [FR] France ..... 78 09193

[51] Int. Cl.[3] ..... E04F 13/08

[52] U.S. Cl. ..... 52/384; 52/391; 52/506

[58] Field of Search ..... 52/384, 392, 474, 506, 52/511, 390, 117, 144, 391

[56] References Cited

U.S. PATENT DOCUMENTS

| | | | |
|---|---|---|---|
| 2,070,839 | 2/1937 | Place | 52/177 |
| 2,662,746 | 12/1953 | Jorn | 52/474 |
| 2,872,804 | 2/1959 | Baldanza | 52/384 |
| 3,657,852 | 4/1972 | Worthington et al. | 52/392 |
| 3,946,529 | 3/1976 | Chevaux | 52/390 |
| 3,998,018 | 12/1976 | Hodges | 52/511 |

FOREIGN PATENT DOCUMENTS

| | | | |
|---|---|---|---|
| 2322670 | 11/1974 | Fed. Rep. of Germany . | |
| 1299476 | 6/1962 | France | 52/144 |
| 1368251 | 6/1964 | France . | |
| 1035817 | 7/1966 | France . | |
| 1374760 | 11/1974 | France . | |
| 2270378 | 6/1975 | France . | |
| 2317433 | 4/1977 | France . | |
| 7006405 | 11/1971 | Netherlands . | |
| 812671 | 4/1959 | United Kingdom | 52/592 |

*Primary Examiner*—James L. Ridgill, Jr.
*Attorney, Agent, or Firm*—Sandler & Greenblum

[57] ABSTRACT

A tile having top and bottom faces for use in constructing dismountable walls, floors and the like, comprising a plurality of flexible clips arranged along one of its faces.

13 Claims, 6 Drawing Figures

TILE FOR THE CONSTRUCTION OF WALLS OR DIVERSE DISASSEMBLABLE SURFACES

The invention relates to a tile whose lower or rear face is provided with means permitting its movable positioning on frames, which are preferably tubular and dismountable.

According to a particularly preferred embodiment, this tile is adapted to make possible assembly and disassembly which is easy, rapid and requires no tools, of floors or pavements of a diverse nature such as the floors of camping tents, the areas surrounding swimming pools, paths to the sea, sidewalks, floors of industrial locals, etc. Nevertheless, these preferred examples of use are not limiting, the tile according to the invention being able, more generally, to be used for the construction of any wall or surface which is horizontal, vertical or inclined such as the lining of walls, separating walls, or ceilings, shelves, etc. Flooring or other dismountable partitions are generally made out of fixed panels mounted on a support with the assistance of screws or threaded shafts (French Pat. No. 76/19120). Such a technique has the inconvenience of requiring extremely long assembly and disassembly times.

The inconveniences of known devices remain major obstacles to the wide-spread use of disassemblable floorings, such that one forgoes floorings in numerous situations where their presence would nevertheless be desirable. This is for example the case in the area of camping and caravaning in which the people, animals or objects situated in the interior or under the awning of a tent or camper, rest directly on the ground or on an insulation carpet, called a "floor carpet" whose insulation qualities are very often very mediocre.

The tile of the invention has specifically as an object to overcome the inconveniences of known devices.

This tile is remarkable by virtue of the fact that it comprises a plurality of elastic clips or clamps arranged on one of its faces and a plurality of openings bored through its thickness and opening between fingers of the elastic clips or clamps.

The tile according to the invention may be instantaneously positioned on a disassemblable frame formed from an assembly of tubes, by simply placing and pushing it on the frame, such that it has the advantage of making possible, as indicated above, the prompt and simple assembly and disassembly, without requiring even the simplest tool, of floorings or other surfaces.

A further advantage of the invention flows from the possibility of piling the tiles with reduced encumberment, for example for purposes of arranging or transporting them, without any risk of breakage of the elastic clips or clamps which perfectly nest in the openings provided through the thickness of the tiles.

In the embodiment of dismountable floorings in which the tiles rest on a tubular armature provided with feet, the invention makes possible to realize planar insulating surfaces provided with sanitary openings for the drainage of water or other liquids.

These aims and characteristics as well as others, will be further evident from the description which follows and the annexed drawings in which:

DESCRIPTION OF PREFERRED EMBODIMENTS

Figure 1:
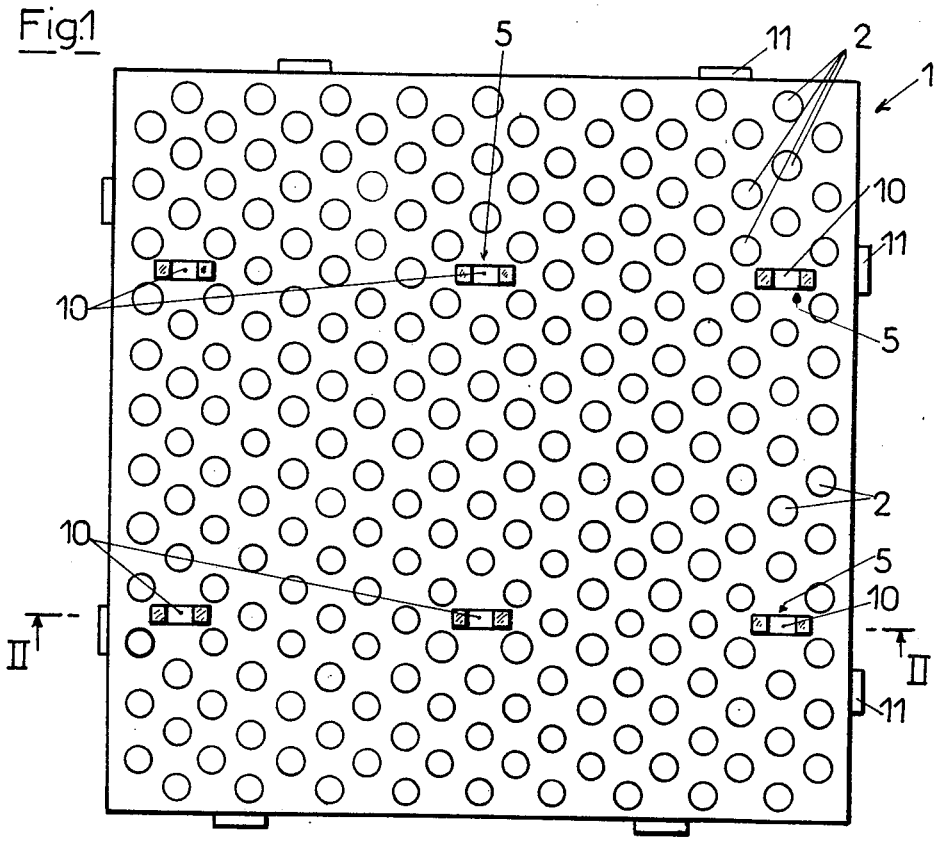
FIG. 1 is a top view of a tile according to the invention.
Figure 2:
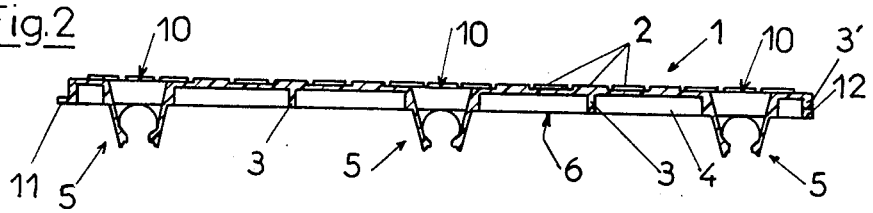
FIG. 2 is a cross-sectional view along the line II—II of FIG. 1.

Referring to the drawings for describing a preferred embodiment, which is in no way limiting, of the tile which forms the objects of the invention. This tile 1 is advantageously molded from a single piece out of any appropriate plastic material having the rigidity required and a certain measure of elasticity. It can be square, rectangular or other.

When the tiles are to be used for the construction of disassemblable floorings, their upper faces comprise, preferably, a plurality of uneven or roughened areas 2, having a circular or other shape, adapted to constitute an anti-slip surface.

The rear or bottom face of the tile comprises, in a preferable embodiment, ribs 3 and 4 intercrossed whose purpose is to increase its rigidity. The end ribs 3' and 4' having a greater thickness are arranged along each of the edges of the tile and constitute a continuous frame. According to the invention, the said rear or lower face of the tile is provided with a plurality of elastic clips or clamps 5 which are advantageously molded out of a single piece with the tile. According to the illustrated example, the tile comprises six elastic clips or clamps 5 extending beyond the bottom face 6 and spread out in three rows or alignments of two clips spaced by a distance 1 which determines the spacing of the parallel tubular elements 7 of the frame on which the tile is adapted to be positioned by simple mounting and pressing.

Figure 4:
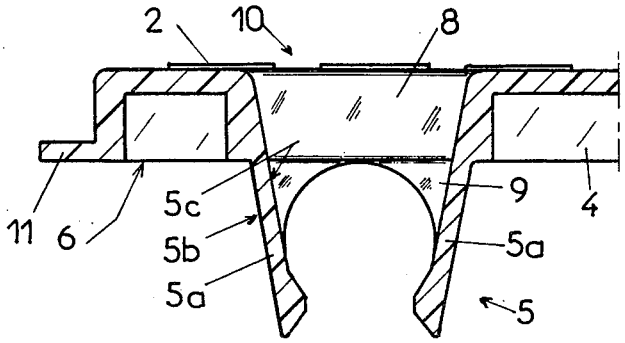
FIG. 4 is a partial cross-sectional view illustrating more particularly an elastic clip or clamp and the opening aligned with the said elastic clip or clamp.
Figure 5:
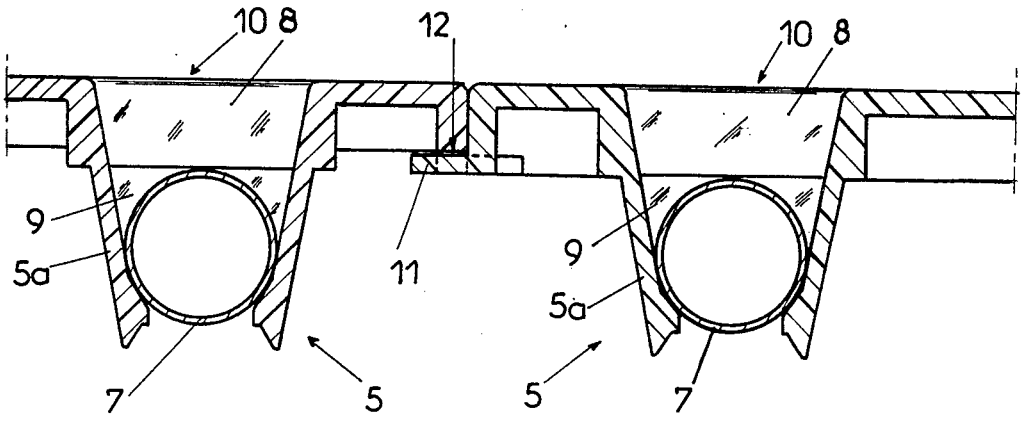
FIG. 5 is a detailed view, in cross-section, illustrating the positioning of two contiguous tiles.

Each elastic clip or clamp 5 comprises a pair of flexible fingers **5*a* arranged facing one another and converging symmetrically, beyond the bottom face 6, in the direction of their free end (FIG. 4). Such that, during the mounting of the tile on the tubular element of the frame, the fingers 5*a* of the clips 5** spread and then squeeze again around the elements as a result of their elasticity. Its attachment on the frame is thus quasi instantaneaous and it is just as fast and easy to remove the tile from the frame, by simple traction.

In order to increase its strength, the base of each elastic clip or clamp comprises by a border 8 having a height identical to that of the reinforcement ribs 3 and 4 and formed, partially or totally, by the said ribs; while the reinforcements 9 having, for example, a groove in the form of an arc or other form corresponding to the profile of the elements 7 of the frame, connect, laterally, the base of each flexible branch **5*a*** at the two parallel sides of the border.

According to an important characteristic of the invention, the tile comprises a plurality of openings 10 going through its thickness and opening between the branches **5*a* of the elastic clips or clamps 5**.

The number of these openings 10, having a rectangular shape, corresponds to that of the elastic clips or clamps 5 and each of these is thus aligned with an elastic clip or clamp.

Figure 6:
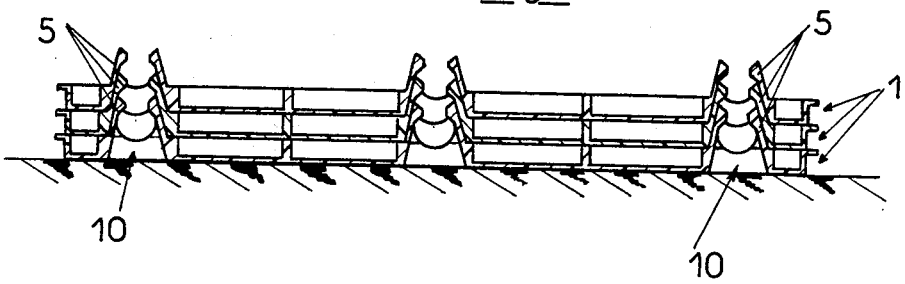
FIG. 6 is a cross-sectional view illustrating a pile of three tiles.

In this fashion, when the tiles are superimposed, the elastic clips or clamps 5 of a tile nest in the openings 10 of the superimposed or the subjacent tile (FIG. 6) depending upon the piling orientation. One thus obtains an automatic centering of the piled tiles in a reduced volume, a perfect equilibrium of the pile and a very good protection of the fixation elements (elastic clips or clamps 5) of the said tiles. In this respect, it is observed that the elastic clamps have, on their portion extending beyond the bottom face 6, and on a portion of the same height defined by the entrances to the openings 10, respectively, identical external slopes 5*b* and internal slopes 5*c*, in a fashion so as to perfectly nest. Furthermore, the portion of the elastic clamps extending beyond the bottom face 6 has a height greater than the tiles, such that, when several tiles are superimposed, the elastic clamps of a tile penetrate to the interior of the two superimposed or subjacent tiles; the alignments of the elastic nested clamps thus constituting strong anchoring points in the interior of the pile.

Figure 3:
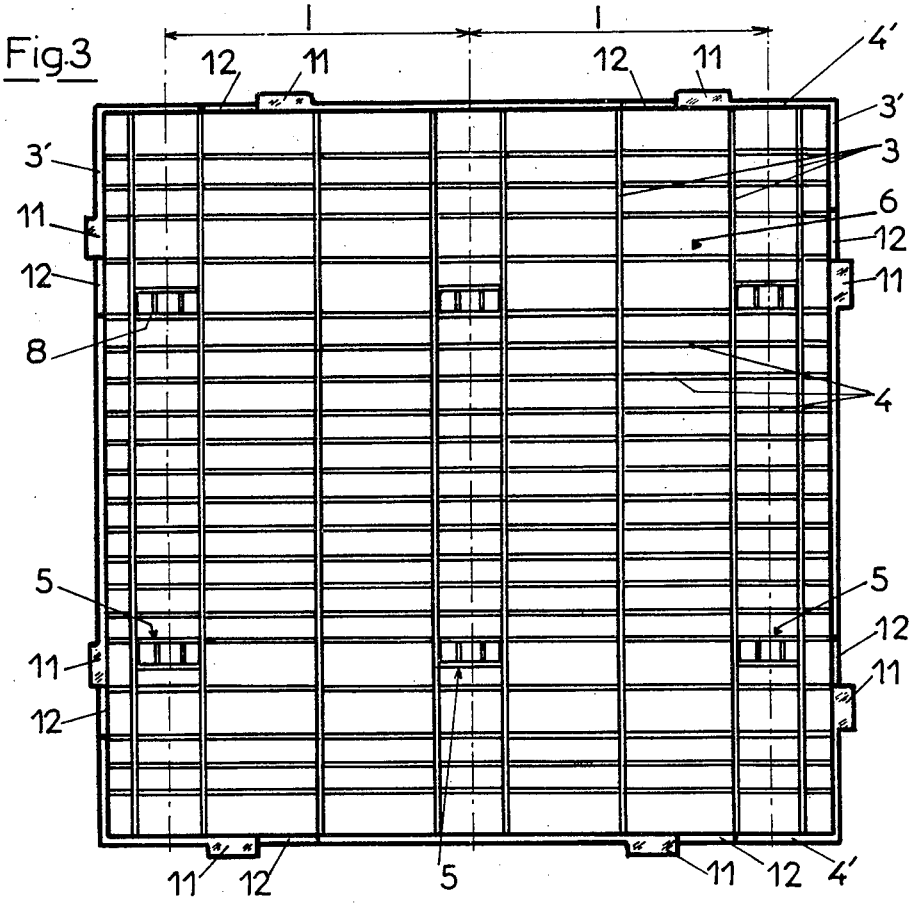
FIG. 3 is a bottom view of the tile.

The tile according to the invention comprises small projections in the form of tongues 11 spread out along its edges, for example in the form of two small tongues per side. These small tongues are integral with the base of the frame or border 3'–4' of the tile. On the other hand, a notch 12 is provided, at the base of the said frame, in the proximity of each small tongue 11, and alongside the latter. The notches 12 have a height and a length slightly greater than that of the small tongues 11 so as to permit the small tongues to fit therein. To this end, and as shown in FIG. 3, the small tongues and the notches of the two parallel sides of the tile, have an inverse position, in a fashion such that the small tongues of the sides adjoining two contiguous tiles can lodge themselves in the notches provided on each of the said sides.

This arrangement makes it possible to realize a reciprocal fitting of the tiles between them; which, in combination with the gripping exerted by the clips 5, assures a strong hold of the tiles on the frame 7.

What is claimed is:

1. A tile having top and bottom faces for use in constructing dismountable walls, floors and the like, comprising a plurality of flexible clips adapted to clip onto a frame arranged along one of its faces, said tile further comprising a plurality of bores extending through said tile, each of said clips comprising two elastic fingers, each of said bores being aligned with one of said clips and positioned to extend between each of said fingers whereby said tiles may be conveniently and securely stacked on one another.

2. The tile as defined by claim 1 in combination with a frame, said clips securing said tile onto said frame.

3. The tile as defined by claim 1 wherein said clips are arranged in at least two rows.

4. The tile as defined by claim 1 wherein said fingers and said tile are of one-piece construction.

5. The tile as defined by claim 1 wherein said clips and sad tile are unitarily molded out of a plastic material.

6. The tile as defined by claim 1 further comprising reinforcement ribs on one of its faces.

7. The tile as defined by claim 6 further comprising roughened areas on one of its faces to prevent slippage.

8. The tile as defined by claim 1 wherein each of said fingers is aligned to face one another and projects outwardly from the bottom surface of said tile, each of said fingers of a given up symmetrically converging towards one another.

9. The tile as defined by either of claim 1 or 8, wherein each of said fingers has an internal surface and an external surface, and wherein each of said surfaces has an identical slope over a portion thereof whereby the outer surfaces of said fingers of a clip on said tile is adapted to nest in the inner surfaces of fingers provided on another of said tiles.

10. The tile as defined by either of claims 1 or 8 wherein the height of said clips extending from the bottom surface of said tile is greater than the thickness of the tile itself.

11. The tile as defined by either of claims 1 or 8 further comprising two reinforcements each being mounted on opposite sides of said clip and extending between each of said fingers thereby connecting each of said fingers.

12. The title as defined by claim 11 wherein each of said reinforcements comprises an inner edge having a shape adapted to be mounted on said frame.

13. The tile as defined by claim 12 wherein said inner edge is in the form of an arc.

* * * * *

UNITED STATES PATENT AND TRADEMARK OFFICE

CERTIFICATE OF CORRECTION

PATENT NO. : 4,267,680

DATED : May 19, 1981

INVENTOR(S) : Jean DELATTRE

It is certified that error appears in the above—identified patent and that said Letters Patent is hereby corrected as shown below:

Column 2, line 16, "objects" should be --object--.

Claim 5, line 13, "sad" should be --said--.

Claim 8, line 23, "up" should be --clip--.

Claim 9, line 25, "claim" should be --claims--.

Signed and Sealed this

*Fourth* Day of *August 1981*

[SEAL]

*Attest:*

GERALD J. MOSSINGHOFF

*Attesting Officer*

*Commissioner of Patents and Trademarks*